US010488170B2

(12) United States Patent
Wangerin

(10) Patent No.: US 10,488,170 B2
(45) Date of Patent: Nov. 26, 2019

(54) COMPUTER CONTROLLED SQUIB SIMULATION SYSTEM

(71) Applicant: Lockheed Martin Corporation, Bethesda, MD (US)

(72) Inventor: Caleb P. Wangerin, Fort Worth, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 281 days.

(21) Appl. No.: 15/485,833

(22) Filed: Apr. 12, 2017

(65) Prior Publication Data

US 2018/0299238 A1 Oct. 18, 2018

(51) Int. Cl.

| | |
|---|---|
| ***F42C 21/00*** | (2006.01) |
| ***F42C 11/00*** | (2006.01) |
| ***F42C 11/06*** | (2006.01) |

(52) U.S. Cl.

CPC ..... *F42C 21/00* (2013.01); *F42C 11/00* (2013.01); *F42C 11/06* (2013.01)

(58) Field of Classification Search

CPC ..... F42C 21/00; F42C 11/00; F42C 11/06
USPC ..... 703/6, 2
See application file for complete search history.

(56) References Cited

U.S. PATENT DOCUMENTS

| | | | | |
|---|---|---|---|---|
| 3,229,123 | A | 1/1966 | Wood | |
| 3,685,347 | A | 8/1972 | Hildebrant et al. | |
| 3,975,942 | A * | 8/1976 | Dreitzler | G01N 33/227 73/35.16 |
| 4,898,340 | A | 2/1990 | Kliger et al. | |
| 4,990,889 | A | 2/1991 | Lebsock | |
| 5,198,612 | A | 3/1993 | Myers | |
| 5,214,236 | A * | 5/1993 | Murphy | F42D 1/05 102/215 |
| H1793 | H * | 4/1999 | Peterson | 323/367 |
| 6,943,555 | B2 | 9/2005 | Dick et al. | |
| 7,154,732 | B2 | 12/2006 | Bennett et al. | |
| 7,154,733 | B2 * | 12/2006 | Sibrai | B60R 21/0173 361/248 |
| 8,563,910 | B2 | 10/2013 | Elwell, Jr. | |
| 9,470,490 | B2 * | 10/2016 | Vabnick | F42B 8/28 |
| 9,561,767 | B2 * | 2/2017 | Darraba | B60R 21/017 |
| 9,618,309 | B2 * | 4/2017 | Barthold | F42C 21/00 |
| 2005/0225924 | A1 * | 10/2005 | Sibrai | B60R 21/0173 361/247 |
| 2005/0225925 | A1 * | 10/2005 | Sibrai | B60R 21/0173 361/247 |
| 2006/0042495 | A1 * | 3/2006 | Russell | F42D 1/05 102/217 |
| 2009/0145321 | A1 * | 6/2009 | Russell | F42B 4/00 102/215 |

(Continued)

*Primary Examiner* — Juan C Ochoa
(74) *Attorney, Agent, or Firm* — Baker Botts L.L.P.

(57) ABSTRACT

In one embodiment, a squib simulation system includes a processor, sensors, and a firing point. The firing point receives electrical pulse information from a computer. The processor calculates electrical pulse information, including time information and current information. The processor determines a received current and determines whether the current exceeds a predetermined threshold necessary to ignite a squib. Upon a determination that the current exceeds the threshold, the processor determines a firing time that a squib would have fired given the current. The processor records and transfers the information to a user.

17 Claims, 3 Drawing Sheets

(56) References Cited

U.S. PATENT DOCUMENTS

| | | | | |
|---|---|---|---|---|
| 2010/0274544 | A1* | 10/2010 | Rachels | F41H 11/02 703/8 |
| 2011/0048271 | A1 | 3/2011 | Colon | |
| 2011/0048273 | A1 | 3/2011 | Colon | |
| 2011/0053118 | A1 | 3/2011 | Colon | |
| 2011/0053119 | A1 | 3/2011 | Colon | |
| 2014/0172343 | A1* | 6/2014 | Pelz | G01R 31/2848 702/117 |

* cited by examiner

COMPUTER CONTROLLED SQUIB SIMULATION SYSTEM

GOVERNMENT INTEREST

This invention was made with government support under contract number FA8611-08-C-2897 awarded by the Department of the Air Force. The government may have certain rights in the invention.

TECHNICAL FIELD

This disclosure generally relates to squib simulation and more particularly to a computer controlled squib and dispenser tester.

BACKGROUND

A squib is an explosive device. Generally, an electronic signal is applied to a squib to trigger an explosion. Squib firing systems may be tested in a simulation environment. For example, a squib simulator may generate and communicate electrical pulses for testing. Conventional squib simulation techniques do not accurately test and measure a squib firing system.

SUMMARY OF PARTICULAR EMBODIMENTS

In one embodiment, a squib simulation system includes a processor and a firing point. The firing point receives electrical pulse information from a computer. The electrical pulse information includes time information and current information. The firing point generates an electrical pulse using the electrical pulse information and communicates the electrical pulse to the processor. The processor determines a received current and determines whether the current exceeds a predetermined threshold necessary to ignite a squib. Upon a determination that the current exceeds the threshold, the processor determines a firing time that a squib would have fired given the current.

In another embodiment, a squib simulation method includes receiving first electrical pulse information for a first electrical pulse from a computer, the first electrical pulse information comprising: first time information indicating a first time to communicate the electrical pulse to a first firing point; and first current information indicating a first amount of current in the electrical pulse; generating the first electrical pulse at the first time, the first electrical pulse having the first amount of current; communicating the first electrical pulse to a first processor; receiving the first electrical pulse; determining a first received current indicating a current received at the first processor; determining whether the first received current exceeds a first predetermined threshold necessary to ignite a first squib of a first squib type; and upon a determination that the first received current exceeds the first predetermined threshold, determining a first firing time based on the first received current, the first firing time indicating a time that the first squib would have fired if receiving the first received current.

Technical advantages of certain embodiments may include accurately measuring electrical signals applied to squibs and determining squib firing characteristics by adjusting the electrical signal characteristics. This provides the technical advantage of generating a more accurate and reliable squib firing system.

Other technical advantages will be readily apparent to one skilled in the art from FIGS. 1-3, descriptions, and claims.

Moreover, while specific advantages have been enumerated above, various embodiments may include all, some, or none of the enumerated advantages.

BRIEF DESCRIPTION OF THE DRAWINGS

For a more complete understanding of the present disclosure and its advantages, reference is now made to the following description, taken in conjunction with the accompanying drawings, in which.

DETAILED DESCRIPTION OF EXAMPLE EMBODIMENTS

Figure 1:
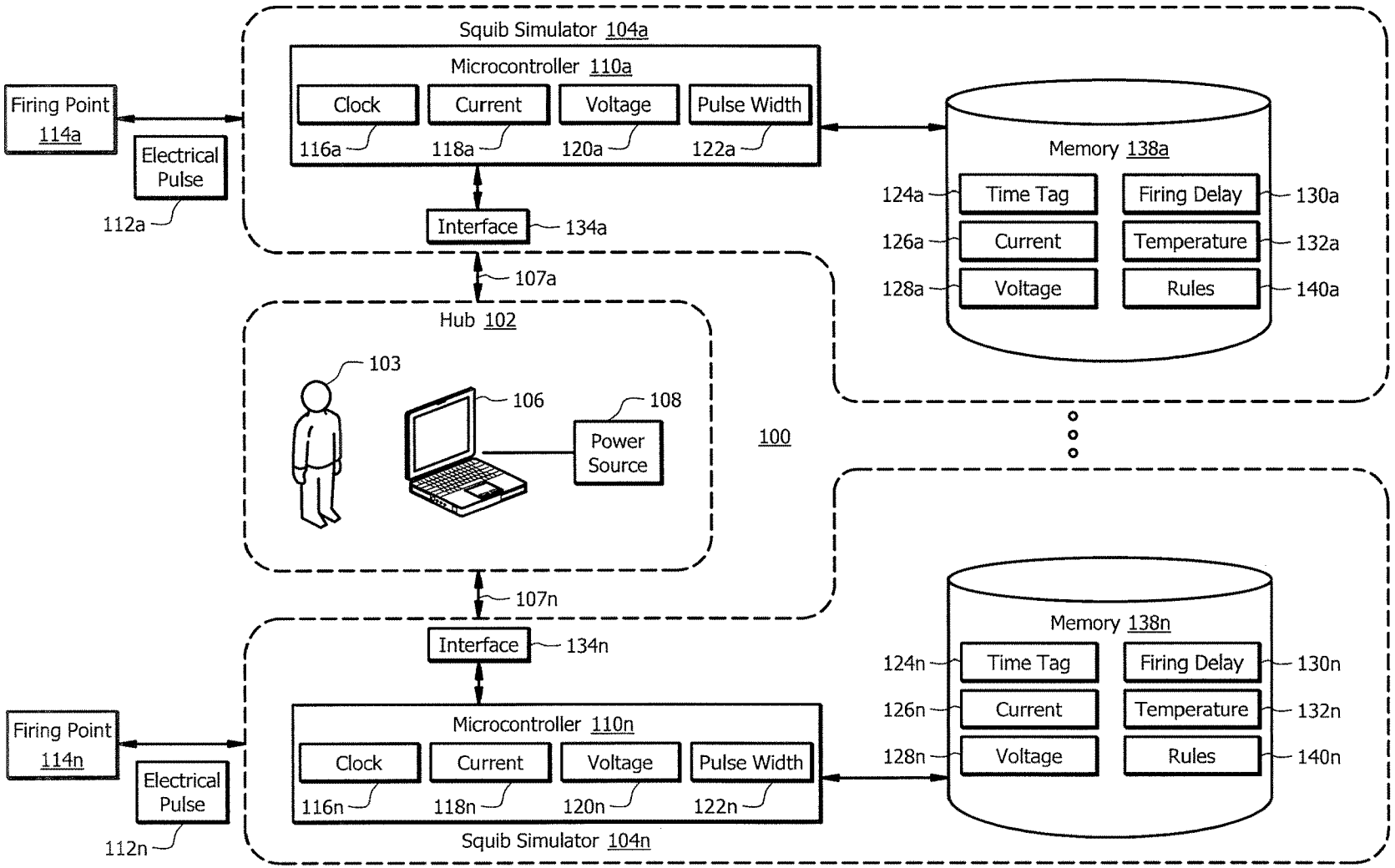
FIG. 1 illustrates a squib simulation system, according to certain embodiments.

A squib is a small explosive device triggered by an electronic signal. Squibs generally include two electrical leads separated by a bridge wire embedded within a heat sensitive chemical composition. As an electronic signal is applied to the bridge wire, the resistance of the bridge wire generates heat, which may cause the chemical composition to ignite, in some embodiments.

The ignition of the chemical composition may generate a small explosion that is useful in a wide range of industries. For example, squibs may be used to create special effects, to simulate bullet impacts on inanimate objects, to expel countermeasures from an aircraft, to deploy airbags, to open locks, or to accomplish any other suitable purpose.

Several types of squibs exist. For example, some aircraft may use one or more BBU-35 squibs, BBU-36 squibs, BBU-59 squibs, and/or BBU-48 squibs. Each of these squibs may have different characteristics. For example, the squibs may have different size, timing, and pressure characteristics. Some squibs may have multiple, separate firing mechanisms within the same squib. Thus, each of the squibs may behave differently to a received electronic input. For example, squibs may fire at different times based on the current, voltage, and/or pulse width associated with an electronic pulse. In some embodiments, a squib may fail to fire based on the characteristics of an electronic pulse.

Accurately simulating a squib's firing characteristics may be important in some industries. For example, an aircraft may expel chaff and/or flare as a countermeasure. The firing characteristics of a squib may be determined through, e.g., testing. For example, a squib of a certain type may be fired using different electrical pulses such as electrical pulses of different currents, pulse widths, temperatures, etc. These characteristics may be used to create a more accurate squib simulator.

Conventional systems typically only determine whether a firing point receives an electrical pulse. Thus, conventional systems may not accurately simulate when a squib may fire after receiving the electrical pulse. Furthermore, conventional systems may not determine whether the electrical pulse is adequate to fire a squib of a certain type. Additionally, conventional systems do not accurately emulate actual squibs and are incapable of testing multiple types of squibs.

The unconventional approach contemplated in this disclosure allows for a collection of squib simulators to interact, allowing for advanced testing of multiple-squib dispensing devices that require precision timing and firing capabilities.

To facilitate a better understanding of the present disclosure, the following examples of certain embodiments are given. The following examples are not to be read to limit or define the scope of the disclosure. Embodiments of the present disclosure and its advantages are best understood by referring to FIGS. 1 through 3, where like numbers are used to indicate like and corresponding parts.

FIG. 1 illustrates a system 100 for squib simulation. In the illustrated embodiment, system 100 includes a hub 102 and one or more squib simulators 104 in communication with one or more firing points 114. Generally, hub 102 communicates information 107 to firing points 114 to initiate squib simulation. Squib simulators 104 may determine squib firing times based on information 107 received from firing points 114. In some embodiments, squib simulator 104 may communicate information 107 to hub 102 to determine squib firing times.

As illustrated in FIG. 1, hub 102 may include a user 103, a user device 106, and a power source 108. Hub 102 generally facilitates providing electricity and firing information 107 to squib simulator 104. In some embodiments, hub 102 may process data received from squib simulator 104 to determine simulated squib firing time.

User 103 is generally a user of squib simulation system 100. For example, user 103 may interact with user device 106 to perform squib simulation. User 103 may provide input to user device 106. For example, user 103 may provide input to user device 106 to facilitate providing information 107 to firing point 114 and/or squib simulator 104, in some embodiments. User 103 may receive information from user device 106 such as squib simulation testing results. Although illustrated as a single user 103, system 100 may include any suitable number of users 103.

User device 106 may be any device that operates and/or communicates with squib simulator 104 and/or other components of system 100. User 103 may utilize device 106 to communicate information 107 to and/or receive information from squib simulator 104. User 103 may utilize user device 106 to receive information 107 from squib simulator 104. Although illustrated as a single user device 106, this disclosure contemplates system 100 including any suitable number of user devices 106.

This disclosure contemplates user device 106 being any appropriate device for sending and receiving communications to and from squib simulator 104. As an example and not by way of limitation, user device 106 may be a computer, a laptop, a wireless or cellular telephone, an electronic notebook, a personal digital assistant, a tablet, or any other device capable of receiving, processing, storing, and/or communicating information with other components of system 100. User device 106 may also include a user interface, such as a display, a microphone, keypad, or other appropriate terminal equipment usable by user 103. In some embodiments, an application executed by user device 106 may perform the functions described herein.

Power source 108 generally provides electricity to squib simulator 104. Power source 108 may be an alternating current power source, in some embodiments. Power source 108 may be a direct current power source, in some embodiments. This disclosure contemplates power source 108 being capable of providing any suitable amount of current and or voltage to squib simulator 104 and/or any other suitable component of system 100. This disclosure contemplates power source 108 being any power source known in the art. Although illustrated as being within hub 102, power source 108 may be within hub 102 and/or squib simulator 104. System 100 may include a plurality of power sources 108, in some embodiments. For example, in the embodiments where system 100 includes a plurality of squib simulators 104, each of the plurality of squib simulators 104 may include one or more power sources 108.

Firing point 114 is generally included in a system under test. As discussed, different systems may utilize squibs. These squibs may be fired from a firing point 114. Firing point 114 generally produces electrical pulses 112 to fire a squib. However, when a system is under test, firing point 114 may provide electrical pulse 112 to squib simulator 104.

Squib simulator 104 includes a microcontroller 110 that receives electrical pulse 112 from firing point 114, in some embodiments. Microcontroller 110 generally receives electrical pulse 112 from firing points 114 and communicates electrical pulse information 107 to hub 102. Microcontroller 110 may include one or more central processing units, a memory, one or more input peripherals, and/or one or more output peripherals. In some embodiments, microcontroller 110 is a processor. For example, microcontroller 110 may be any electronic circuitry, including, but not limited to microprocessors, application specific integrated circuits (ASIC), application specific instruction set processor (ASIP), and/or state machines, that communicatively couples to memory 138 and interface 134 and controls the operation of system 100. Microcontroller 110 may be 8-bit, 16-bit, 32-bit, 64-bit or of any other suitable architecture. Microcontroller 110 may include an arithmetic logic unit (ALU) for performing arithmetic and logic operations, processor registers that supply operands to the ALU and store the results of ALU operations, and a control unit that fetches instructions from memory 138 and executes them by directing the coordinated operations of the ALU, registers and other components. Microcontroller 110 may include other hardware and software that operates to control and process information. Microcontroller 110 executes software stored on memory 138 to perform any of the functions described herein. Microcontroller 110 controls the operation and administration of system 100 by processing information received from interface 134 and/or any other suitable component of system 100. Microcontroller 110 may be a programmable logic device, a microcontroller, a microprocessor, any suitable processing device, or any suitable combination of the preceding. While illustrated as being part of squib simulator 104, microcontroller 110 may be a part of hub 102. For example, user device 106 may include microcontroller 110. In the embodiments where system 100 includes more than one squib simulator 104, a plurality of squib simulators 104 may be associated with a single microcontroller 110. This disclosure contemplates any suitable type of microcontroller known in the art.

In the illustrated embodiment, microcontroller 110 includes a clock 116. Clock 116 may be a system clock, in some embodiments. Clock 116 generally measures units of time. Clock 116 may include hardware and/or software components to measure time. System 100 may include a plurality of clocks 116 in some embodiments. For example, user device 106 may include a clock 116. In some embodiments, firing point 114 may include a clock 116. In the embodiment where squib system 100 includes a plurality of squib simulators 104, each squib simulator 104 may include one or more clocks 116. Each clock 116 may be synchronized, in some embodiments. For example, each clock 116 may keep time within a number of nanoseconds. Synchronizing clocks 116 increases the accuracy of squib simulation by allowing system 100 to determine and indicate squib timing characteristics.

Microcontroller 110 may receive electrical pulse 112 having current 118, voltage 120, and/or pulse width 122, in some embodiments. Current 118 indicates an amount of amperage associated with electrical pulse 112. Voltage 120 indicates an amount of voltage associated with electrical pulse 112. As known in the art, current and voltage of an electrical pulse may not be mutually exclusive, in some embodiments. Current 118 and voltage 120 are generally measurements of electrical current that are known in the art. Microcontroller 110 may receive an electrical pulse 112 having a pulse width 122. Pulse width 122 generally indicates a length of time that electrical pulse 112 is active. For example, microcontroller 110 may receive an electrical pulse 112 with a pulse width 122 of one half millisecond, one millisecond, five milliseconds, one second, or any suitable amount of time.

In the illustrated embodiments, squib simulator 104 includes interface 134. Interface 134 may represent any suitable device operable to receive information from one or more components of system 100, transmit information to one or more components of system 100, perform suitable processing of the information, or any combination of the preceding. For example, interface 134 transmits data to hub 102. As another example, interface 134 receives electrical pulse 112 from firing point 114. This disclosure contemplates interface 134 receiving information from and communicating information to any component of system 100 and/or any other suitable component. Interface 134 represents any port or connection, real or virtual, including any suitable hardware and/or software, including protocol conversion and data processing capabilities, to communicate through a LAN, WAN, or other communication systems that allows firing point 114 to communicate with components of system 100. Interface 134 may include one interface or any number of interfaces.

Memory 138 may store, either permanently or temporarily, data, operational software, or other information for microcontroller 110. Memory 138 may include any one or a combination of volatile or non-volatile local or remote devices suitable for storing information. For example, memory 138 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in memory 138, a disk, a CD, or a flash drive. In particular embodiments, the software may include an application executable by microcontroller 110 to perform one or more of the functions described herein. In particular embodiments, memory 138 stores rules 140, time tag 124, current 126, voltage 128, firing delay 130, temperature 132, and/or any other suitable information. This disclosure contemplates memory 130 storing any of the elements stored AR user device 110, local server 126, and/or any other suitable components of system 100.

Rules 140 generally refer to logic, rules, algorithms, code, tables, and/or other suitable instructions embodied in a computer-readable storage medium for performing the described functions and operations of system 100. For example, rules 140 may include squib characteristic information and/or squib dispenser characteristic information. As discussed, squibs may fire at particular times based on received current and/or any other suitable type of input. Squib dispensers may also have characteristics. For example, a squib dispenser may not apply all of electrical pulse 112 to a squib. Squib dispensers may have loss that does not allow all of electrical pulse 112 to reach a squib. Microcontroller 110 utilizes rules 140 to determine current 126, voltage 128, firing delay 130, temperature 132, and/or time tag 124. Information included in graph 200 of FIG. 2, discussed below, may be used to facilitate generating rules 140.

Current 126 and voltage 128 generally indicate a current and voltage that would be applied to a particular squib in a particular squib dispenser if the squib dispenser received electrical pulse 112. As discussed, squib dispensers and squibs may have varying characteristics that affect the amount of current and voltage that is applied to a squib. Firing point 114 receives electrical pulse 112 and uses rules 140 to determine that amount of current 126 and voltage 128 that would be applied to a particular squib using a particular squib dispenser. Firing point 114 may use a voltmeter to facilitate determining current 126 and/or voltage 128, in some embodiments. This allows system 100 to simulate a squib dispensing system.

Memory 138 may include temperature 132, in some embodiments. Temperature 132 generally indicates the temperature across a squib upon receiving all or a portion of electrical pulse 112. Microcontroller 110 may use electrical pulse 112 and rules 140 to determine temperature 132.

Microcontroller 110 may use rules 140 to determine time tag 124. In some embodiments, microcontroller 110 may use current 126, voltage 128, temperature 132, electrical pulse 112 with rules 140 to determine time tag 124. Time tag 124 is generally an indication of a time that a squib of a particular squib type in a particular dispenser would have fired in real-world conditions. As discussed, rules 140 may include squib characterization information and squib dispenser characterization information. This information may be used to determine a time that a squib would fire after receiving current 124 and/or voltage 128. Microcontroller 110 may utilize clock 116 to determine time tag 214.

Microcontroller 110 may use rules 140 to determine firing delay 130. Firing delay 130 is generally the amount of time between when firing point 114 received electrical pulse 112 and the time indicated by time tag 124. Thus, firing delay 130 may indicate the delay for a squib to fire after firing point 114 receives electrical pulse 112.

In an example embodiment, user 103 may provide input to computer 106 to perform squib simulation. For example, user 103 provides instructions to generate a first electrical pulse 112*a* for a first firing point 114*a* and a second electrical pulse 112*b* for a second firing point 114*b*, in some embodiments. User 103 may input instructions to produce electrical pulse 112*a* with a current 118*a* and pulse width 122*a* at a first time. User 103 may input instructions to produce electrical pulse 112*b* with a pulse 118*b* and pulse width 122*b* at a second time. In some embodiments, the first time may be different than the second time. Current 118*a* may be different from current 118*b*, and pulse width 122*a* may be different than pulse width 122*b*. User 103 may indicate to simulate a first squib type using a first squib dispenser for using squib simulator 104*a* and a second squib type using a second squib dispenser using squib simulator 104*b*. Firing points 114 may generate electrical pulses 112 in response to the input from user 103. In some embodiments, firing points 114 may generate electrical pulse 112 with little or no input from user 103. Microcontroller 110 may use different portions of rules 140 to make calculations based on the particular squib type and squib dispenser that user 103 indicates, in some embodiments.

Hub 102 may communicate information 107 (e.g., 107*a-n*) to firing points 114*a* and/or 114*b* (e.g., using user device 106) to produce electrical pulse 112*a* and electrical pulse 112*b*, respectively. Firing points 114 may receive the commands from hub 102 and produce electrical pulse 112*a* and electrical pulse 112*b* at the first time and the second time, respectively. Interface 134*a* receives electrical pulse 112*a*, and interface 134*b* receives electrical pulse 112*b*, in some embodiments. Microcontroller 110 may use the received electrical pulse 112 and rules 140 to determine current 126, voltage 128, temperature 132, and time tag 124, in some embodiments. In some embodiments, the microcontrollers 110 communicate information to hub 102, which determines current 126, voltage 128, temperature 132, and time tag 124 for each of the firing points using rules 140.

User device 106 may receive time tag 124, current 126, voltage 128, firing delay 130, and temperature 132 for one or more squib simulators 104 and generate a report indicating the information for the one or more squib simulators 104.

Squib simulation system 100 allows user 103 to determine the current 118, voltage 120, and/or pulse width 122 in squib simulation. Furthermore, squib simulation system 100 allows for simulation of multiple squib types and squib dispenser types based on the characteristics of the squib types and squib dispensers that are included in rules 140, in some embodiments. Squib simulation system 100 allows simulation of a plurality of squib dispensers using a single power source.

Modifications, additions, or omissions may be made to system 100 without departing from the scope of the invention. For example, system 100 may include any number of hubs 102, firing points 114 and/or squib simulators 104. Furthermore, the components of system 100 may be integrated or separated. Components may be located in any particular location. For example, rules 140 may be located within user device 106, and user device 106 may use rules 140 to determine any elements stored in memory 138. Furthermore, user device 106 may store any elements store in memory 138.

Figure 2:
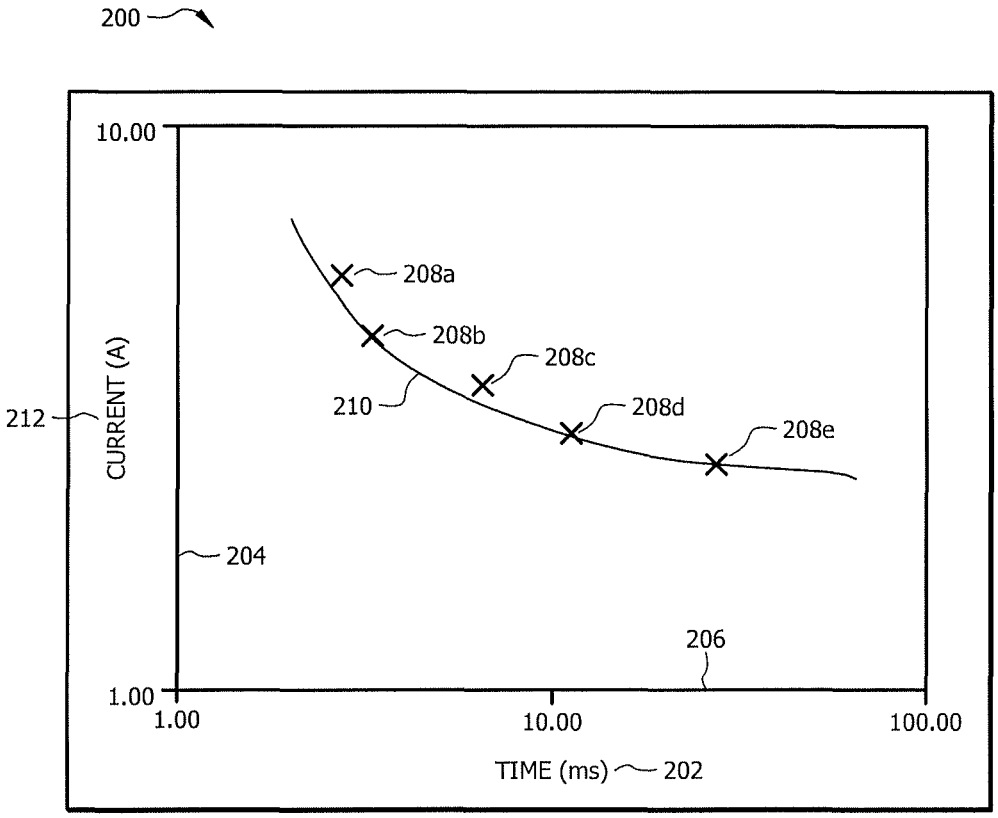
FIG. 2 illustrates an example chart for determining squib firing characteristics, according to certain embodiments.

FIG. 2 illustrates an example chart of squib firing characteristics, according to certain embodiments. The graph 200 of FIG. 2 generally indicates firing times of a particular squib when provided with a particular current. The information contained in FIG. 2 may be used to facilitate generating rules 140, in some embodiments. The information may be generated by testing particular squibs and/or particular squib dispensers. As illustrated, graph 200 may include x-axis 206 indicating time 202, y-axis 204 indicating current 212, one or more data points 208, and curve fitting line 210. X-axis 206 is generally the x-axis of graph 200. X-axis 206 may indicate time 202. Time 202 may indicate the amount of time required for a squib to fire. As illustrated, time 202 may be in milliseconds. Time 202 may be in nanoseconds, milliseconds, seconds, or any other suitable time measurement. Y-axis 204 is generally the y-axis of graph 200. Y-axis 204 may indicate current 212. Current 212 may indicate an amount of current applied to a squib. As illustrated, y-axis 204 indicates current 212 in amps. Current 212 may be in milliamps, amps, or any other suitable measurement of current.

Data points 208 generally indicate an amount of time 202 required for a squib to fire given a particular current 212. Data points 208 may be generated by testing. For example, a varying amount of current may be applied to a particular squib. The squib may be a live squib in some embodiments. The squib may be an inert squib in some embodiments. A first current may be applied to a squib, and a measurement of time may be taken to determine the amount of time required for the squib to fire. These tests may be completed for a varying amount of currents using the squib type to generate a plurality of data points 208.

Curve fitting line 210 may be a curve or mathematical function that best fits data points 208. Generating a curve fitting line 210 using data points 208 is well known in the art. Curve fitting line 210 generally indicates an amount of time 202 required for a squib to fire given a particular amount of current 212. This information may be used to generate rules 140. For example, curve fitting line 210 may indicate that a particular squib may fire after ten milliseconds when receiving a current of five amps. This information may be included in rules 140. Thus, when firing point 114 receives electrical pulse 112 that generates a current 126 of five amps, in this example, microcontroller 110 may utilize rules 140 to determine that a squib of a particular type may fire ten milliseconds after receiving the current 126.

Testing may be done for a plurality of squib types and a plurality of squib dispensers. The testing results of each of the squibs and/or squib dispensers may be used to generate rules 140 as discussed. Although y-axis 204 indicates current 212 in the illustrated embodiment, y-axis 204 may indicate voltage, temperature, or any other measurement that may be used to generate rules 140.

Figure 3:
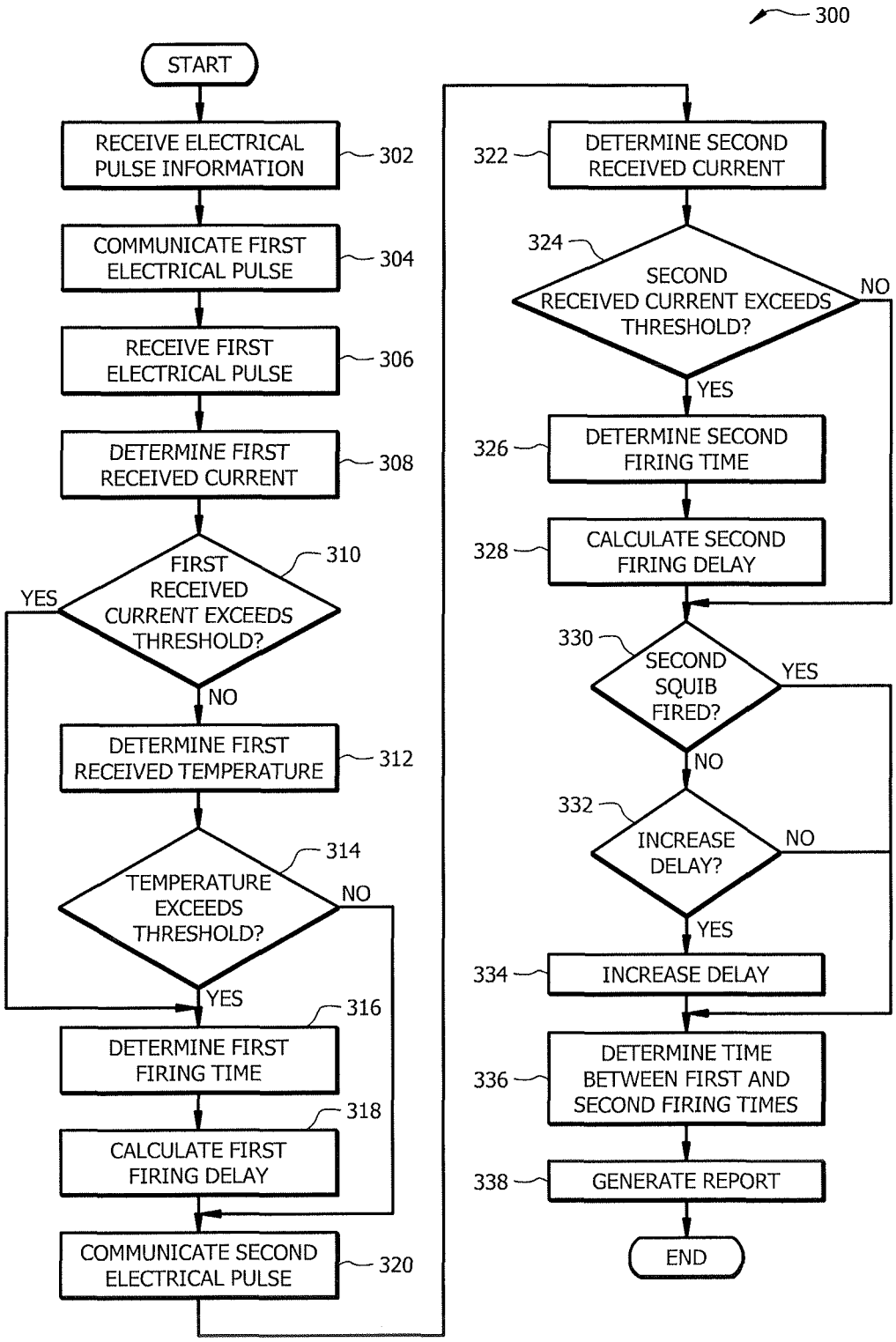
FIG. 3 illustrates a method for squib simulation, according to certain embodiments.

FIG. 3 illustrates a method 300 for squib simulation, according to certain embodiments. In particular embodiments, system 100 performs method 300. By performing method 300, system 100 increases the accuracy and capability of performing squib simulations.

Method 300 begins at step 302 where firing point 114 receives electrical pulse information from hub 102. Electrical pulse information may include time information indicating a first time to communicate a first electrical pulse 112 to microcontroller 110. In some embodiments, electrical pulse information may indicate first current information indicating a first amount of current in electrical pulse 112. Firing point 114 communicates the first electrical pulse 112 to microcontroller 110 at step 304, and microcontroller 110 receives first electrical pulse 112 at step 306. Microcontroller 110 may determine first received current 126 at step 308 and determine whether the first received current 126 exceeds a predetermined threshold necessary to ignite a first squib of a first squib type at step 310.

Upon a determination in step 310 that the first received current 126 exceeds the first predetermined threshold, method 300 proceeds to step 316, in some embodiments. If it is determined in step 310 that the first received current 126 does not exceed the predetermined threshold, method 300 may proceed to step 312 where microcontroller 110 determines whether the received current 126 would have generated a temperature exceeding a predetermined threshold indicating that a squib would have fired. For example, microcontroller 110 may utilize rules 140 including squib characteristics to determine the temperature and predetermined threshold. If the temperature does not exceed a predetermined threshold as determined in step 314, method 300 proceeds to step 320. Otherwise method 300 may proceed to step 316 where microcontroller 110 determines a first firing time. For example, time tag 124 may indicate the first firing time.

At step 318, method 300 determines a first firing delay 130. Microcontroller 110 may determine first firing delay 130 by subtracting the first time from the time indicated by time tag 124, as discussed.

At step 320, the first firing points 114 communicate a second electrical pulse 112 to squib simulator 104. In some embodiments, firing point 114 may receive second electrical pulse information to generate the second electrical pulse 112. The second electrical pulse 112 may have a second amount of current that is different than the first amount of current in the first electrical pulse 112. In some embodiments, the second electrical pulse 112 is communicated after a first delay period. Microcontroller 110 determines a second received current 126 in the manner previously discussed at step 322 and determines whether the second received current 126 exceeds the first predetermined threshold at step 324. If the second received current 126 does not exceed the predetermined threshold, method 300 proceeds to step 330. Otherwise, method 300 proceeds to step 326 where microcontroller 110 determines a second firing time using time tag 124. Microcontroller 110 may determine a second firing delay 130, as previously discussed.

Microcontroller 110 determines whether a second squib would have fired at step 330. Microcontroller 110 may make this determination by any method previously discussed. In some embodiments, the second squib may not have fired because the first delay time between the first and second electrical pulses 112 may be too short. If the second squib did not fire, microcontroller 110 may determine whether to increase the first delay time in step 332. If microcontroller 110 does determine to increase the delay time, method 300 proceeds to step 334 where microcontroller 110 indicates that the delay should be increased. Otherwise method 300 proceeds to step 336 where microcontroller 110 determines the time between the first and second firing times (e.g., by using the first and second time tags 124). Method 300 may proceed to step 338 where user device 106 generates a report. The report may indicate the first and second firing delays, the first and second received currents 126, and/or any other suitable information.

Modifications, additions, or omissions may be made to method 300 depicted in FIG. 3. Method 300 may include more, fewer, or other steps. For example, steps may be performed in parallel or in any suitable order. As another example, a second microcontroller 110 of a second squib simulator 104 may communicate the second electrical pulse 112 to a second firing point 114 in step 320. In this embodiment, both the first and second squib simulators may include a clock 116. Both of the clocks 116 may be synchronized to determine the time between first and second firing times at step 336. While discussed as particular components of system 100 performing the steps, any suitable component of system 100, may perform one or more steps of the method.

Although this disclosure describes and illustrates respective embodiments herein as including particular components, elements, functions, operations, or steps, any of these embodiments may include any combination or permutation of any of the components, elements, functions, operations, or steps described or illustrated anywhere herein that a person having ordinary skill in the art would comprehend.

Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, functions, operations, or steps, any of these embodiments may include any combination or permutation of any of the components, elements, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A squib simulation system comprising:

a firing point configured to:

receive first electrical pulse information for a first electrical pulse from a computer, the first electrical pulse information comprising:

first time information indicating a first time to communicate the first electrical pulse to a first firing point; and first current information indicating a first amount of current in the first electrical pulse;

generate the first electrical pulse at the first time, the first electrical pulse having the first amount of current; and communicate the first electrical pulse to a first processor; and the first processor configured to:

receive the first electrical pulse;

determine a first received current indicating a current received at the first firing point;

determine whether the first received current exceeds a first predetermined threshold necessary to ignite a first squib of a first squib type; and upon a determination that the first received current exceeds the first predetermined threshold, determine a first firing time based on the first received current, the first firing time indicating a time that the first squib would have fired if receiving the first received current;

wherein:

the first processor comprises a first clock and the first firing point comprises a second clock;

the first clock and the second clock are synchronized; and the first clock facilitates determining the first time and the second clock facilitates determining the first firing time.

2. The system of claim 1, wherein:

the firing point is further configured to generate a second electrical pulse at a second time, the second electrical pulse having a second amount of current, the second amount of current different than the first amount of current; and the first processor is further configured to:

receive the second electrical pulse;

determine a second received current indicating a current received in response to the second electrical pulse;

determine whether the second received current exceeds the first predetermined threshold; and upon a determination that the second received current exceeds the first predetermined threshold, determine a second firing time based on the second received current, the second firing time indicating a time that a second squib would have fired if receiving the second received current.

3. The system of claim 2, wherein:

the first firing point is further configured to communicate the second electrical pulse after a first delay period of the first electrical pulse; and upon a determination that the second received current did not exceed the first predetermined threshold, the first processor further configured to increase the first delay period to determine a second delay period.

4. The system of claim 2, wherein the computer is further configured to:

calculate a first firing delay using the first time and the first firing time and associate the first firing delay with the first amount of current;

calculate a second firing delay using the second time and the second firing time and associate the second firing delay with the second amount of current; and generate a report indicating the first firing delay, the first amount of current, the second firing delay, and the second amount of current.

5. The system of claim 1, wherein the first processor is further configured to determine whether the received current generated a temperature exceeding a predetermined threshold, wherein exceeding the predetermined threshold indicates that a squib would have fired.

6. The system of claim 1, further comprising a second microcontroller in communication with the computer and a second firing point, the second microcontroller comprising a third clock that is synchronized with the first clock and the second clock and the second microcontroller configured to communicate a second electrical pulse to the second firing point.

7. A squib simulation method comprising:

receiving first electrical pulse information for a first electrical pulse from a computer, the first electrical pulse information comprising:

first time information indicating a first time to communicate the first electrical pulse to a first firing point; and first current information indicating a first amount of current in the first electrical pulse;

generating the first electrical pulse at the first time, the first electrical pulse having the first amount of current;

communicating the first electrical pulse to a first processor;

receiving the first electrical pulse;

determining a first received current indicating a current received at the first firing point;

determining whether the first received current exceeds a first predetermined threshold necessary to ignite a first squib of a first squib type;

upon a determination that the first received current exceeds the first predetermined threshold, determining a first firing time based on the first received current, the first firing time indicating a time that the first squib would have fired if receiving the first received current; and determining whether the first received current generated a temperature exceeding a predetermined temperature threshold, wherein exceeding the predetermined temperature threshold indicates that a squib would have fired.

8. The method of claim 7, further comprising:

generating a second electrical pulse at a second time, the second electrical pulse having a second amount of current, the second amount of current different than the first amount of current;

receiving the second electrical pulse;

determining a second received current indicating a current received in response to the second electrical pulse;

determining whether the second received current exceeds the first predetermined threshold; and upon a determination that the second received current exceeds the first predetermined threshold, determining a second firing time based on the second received current, the second firing time indicating a time that a second squib would have fired if receiving the second received current.

9. The method of claim 8, further comprising:

communicating the second electrical pulse after a first delay period of the first electrical pulse; and upon a determination that the second received current did not exceed the predetermined threshold, increasing the first delay period to determine a second delay period.

10. The method of claim 8, further comprising:

calculating a first firing delay using the first time and the first firing time and associate the first firing delay with the first amount of current;

calculating a second firing delay using the second time and the second firing time and associate the second firing delay with the second amount of current; and generating a report indicating the first firing delay, the first amount of current, the second firing delay, and the second amount of current.

11. The method of claim 7, further comprising synchronizing a first clock and a second clock, wherein the first clock facilitates determining the first time and the second clock facilitates determining the first firing time.

12. The method of claim 11, further comprising synchronizing a third clock with the first clock and the second clock.

13. A non-transitory computer-readable medium comprising a memory storing software, the software when executed by one or more processing units operable to:

receive first electrical pulse information for a first electrical pulse from a computer, the first electrical pulse information comprising:

first time information indicating a first time to communicate the first electrical pulse to a first firing point; and first current information indicating a first amount of current in the first electrical pulse;

communicate the first electrical pulse to a first processor;

receive the first electrical pulse;

determine a first received current indicating a current received at the first firing point;

determine whether the first received current exceeds a first predetermined threshold necessary to ignite a first squib of a first squib type;

upon a determination that the first received current exceeds the first predetermined threshold, determine a first firing time based on the first received current, the first firing time indicating a time that the first squib would have fired if receiving the first received current; and synchronize a first clock and a second clock, wherein the first clock facilitates determining the first time and the second clock facilitates determining the first firing time.

14. The medium of claim 13, the software when executed by one or more processing units further operable to:

receive a second electrical pulse at a second time, the second electrical pulse having a second amount of current, the second amount of current different than the first amount of current;

determine a second received current indicating a current received in response to the second electrical pulse;

determine whether the second received current exceeds the first predetermined threshold; and upon a determination that the second received current exceeds the first predetermined threshold, determine a second firing time based on the second received current, the second firing time indicating a time that a second squib would have fired if receiving the second received current.

15. The medium of claim 14, the software when executed by one or more processing units further operable to:

communicate the second electrical pulse after a first delay period of the first electrical pulse; and upon a determination that the second received current did not exceed the first predetermined threshold, increase the first delay period to determine a second delay period.

16. The medium of claim 14, the software when executed by one or more processing units further operable to:

calculate a first firing delay using the first time and the first firing time and associate the first firing delay with the first amount of current;

calculate a second firing delay using the second time and the second firing time and associate the second firing delay with the second amount of current; and generating a report indicating the first firing delay, the first amount of current, the second firing delay, and the second amount of current.

17. The medium of claim 13, the software when executed by one or more processing units further operable to determine whether the received current generated a temperature exceeding a predetermined threshold, wherein exceeding the predetermined threshold indicates that a squib would have fired.

* * * * *